US006447087B1

(12) United States Patent
Kao et al.

(10) Patent No.: US 6,447,087 B1
(45) Date of Patent: Sep. 10, 2002

(54) METHOD FOR DRIVING AN INK JET PRINT HEAD OF A PRINTING APPARATUS

(75) Inventors: Chih-Hung Kao, Taipei (TW); Yu-Fan Fang, Taipei (TW)

(73) Assignee: Acer Communications and Multimedia Inc., Taoyuan (TW)

( * ) Notice: Subject to any disclaimer, the term of this patent is extended or adjusted under 35 U.S.C. 154(b) by 0 days.

(21) Appl. No.: 09/972,570

(22) Filed: Oct. 9, 2001

(51) Int. Cl.[7] ..... B41J 29/38
(52) U.S. Cl. ..... 347/12; 347/14
(58) Field of Search ..... 347/12, 15, 17, 347/190, 194, 196; 400/120.1, 120.15, 124.04

(56) References Cited

U.S. PATENT DOCUMENTS 4,607,262 A * 8/1986 Moriguchi et al. ..... 347/196
5,497,174 A * 3/1996 Stephany et al. ..... 347/13

* cited by examiner

*Primary Examiner*—John S. Hilten
*Assistant Examiner*—Alfred E. Dudding
(74) *Attorney, Agent, or Firm*—Winston Hsu

(57) ABSTRACT

A method for driving an ink jet print head of a printing apparatus is disclosed. The ink jet print head includes a plurality of ink cells for containing ink, Each ink cell has a nozzle and a heating element. The method includes calculating an index of each nozzle which will jet ink in an array, corresponding indices of all nozzles which will jet ink in the array to heat-accumulation weightings according to a heat-accumulation weighting table, using the calculation module to calculate a total weight of the array using the heat-accumulation weightings of all the nozzles which will jet ink in the array, and using a driving module to provide energy to heating elements corresponding to the nozzles which will jet ink according to the total weight of the array.

20 Claims, 13 Drawing Sheets

170

| | | | | | | |
|---|---|---|---|---|---|---|
| Heat-accumulation index (m) | 1 | 2 | 3 | 4 | 5 | ... |
| Heat-accumulation weighting ( W(m) ) | a | b | c | d | e | ... |
| Heat-accumulation weighting value | 1 | 2 | 3 | 4 | 5 | ... |

172 174 176

Fig. 6A

180

| | | | | | | |
|---|---|---|---|---|---|---|
| Heat-dilution index (k) | 1 | 2 | 3 | 4 | 5 | ... |
| Heat-dilution weighting ( C(k) ) | A | B | C | D | E | ... |
| Heat-dilution weighting value | 0 | 1 | 1 | 2 | 2 | ... |

182 184 186

Fig. 6B

C1=a+b+a
=1+2+1=4
C2=a
=1
C3=a+a
=1+1=2

R1=a=1
R2=a+a=1+1=2
R3=a=1
R4=a=1
R5=a=1

SUM=C1+C2+C3+R1
+R2+R3+R4+R5
=4+1+2+1+2+1+1+1
=13

220

C1=a+b+c
=1+2+3=6
C2=a+b+c
=1+2+3=6
C3=0

R1=a+b=1+2=3
R2=a+b=1+2=3
R3=a+b=1+2=3
R4=0
R5=0

SUM=C1+C2+C3+R1
+R2+R3+R4+R5
=6+6+0+3+3+3+0+0
=21

METHOD FOR DRIVING AN INK JET PRINT HEAD OF A PRINTING APPARATUS

BACKGROUND OF THE INVENTION

1. Field of the Invention

The present invention relates to a method for driving an ink jet print head of a printing apparatus, and more particularly, to a method for driving an ink jet print head of a printing apparatus to make temperature compensation and provide uniform ink spots.

2. Description of the Prior Art

Please refer to FIG. 1. FIG. 1 is a schematic diagram of a prior art ink jet print head 70. The ink jet print head comprises an ink reservoir 72, a plurality of tubes 74 and a plurality of ink-ejecting chambers 76. The plurality of tubes 74 connects the ink reservoir 72 to the plurality of ink-ejecting chambers 76. Ink inside the ink reservoir 72 can flow through the tubes 74 to the ink-ejecting chambers 76. Inside each ink-ejecting chamber 76 is a heating resistor 78 that heats up the ink, increasing the ink's thermal energy. When the thermal energy of the ink in the ink-ejecting chamber 76 is above a predetermined threshold, the ink generates bubbles 80 to eject ink spots from an orifice 82 for printing. When the orifice 82 receives many instructions successively to eject ink spots, the heating resistor 78 of the orifice 82 continually heats up, and ink inside the ink-ejecting chamber 76 has a higher temperature and a lower viscosity. If, however, another orifice 82 receives fewer instructions to eject ink spots, ink inside the ink-ejecting chamber 76 has a lower temperature and a higher viscosity. If the same amount of energy is used to drive the heating resistors 78 of these two orifices 82, non-uniform ink spots are ejected and the printing quality is lowered. So, the energy provided by the heating resistor 78 in the ink jet print head 70 not only makes the thermal energy of ink in the ink-ejecting chamber 76 higher than the predetermined threshold, but can also be adjusted to make the sizes of ejected ink spots uniform and optimize printing quality.

Please refer to FIG. 2. FIG. 2 is a schematic diagram of a prior art driving circuit of an ink jet print head. For example, a driving circuit 10 can receive an input of eight printing data and produce eight controlling signals (D1, D2, D3, D4, D5, D6, D7, D8) to output to an ink jet print head 40. The ink jet print head 40 has a heating circuit 42 and eight ink-ejecting chambers (R1, R2, R3, R4, R5, R6, R7, R8). The driving circuit 10 has a shift register 22, a latching circuit 24 and a driving module 26. The shift register 22 receives binary printing data 30 transmitted serially from the printing apparatus. Then, the latching circuit 24 latches the printing data 30 and stores the printing data 30 in the latching circuit 24 according to a latch signal 34. The driving module 26 consists of a plurality of AND gates 28 and causes the heating circuit 42 in the ink jet print head 40 to heat up each predetermined ink-ejecting chamber according to a driving signal 36. The heating circuit 42 consists of a plurality of heating resistors 78 and transistor switches 44. Each transistor switch 44 is linked from its corresponding control signal (D1, D2, D3, D4, D5, D6, D7, D8) to the AND gate it controls. When a specific control signal is turned on, the corresponding transistor switch 44 turns on, current flows through the corresponding heating resistor 78, the corresponding ink-ejecting chamber is heated up, and ink inside the ink-ejecting chamber is ejected as ink spots to print.

Please refer to FIG. 3. FIG. 3 is a timing diagram for a first driving pattern of a prior art ink jet print head. The thermal energy of ink inside the ink-ejecting chamber 76 is influenced by energy provided by the heating resistor 78 and other factors, such as the number of ink-ejecting chambers to be driven in a printing process. When there are more ink-ejecting chambers to be driven in a printing process, the heating resistor 78 provides less energy to these ink-ejecting chambers. Between T0 and T1, eight printing data 30 are input to the shift register 22 in order to control a pulse signal 32. When the latching signal 34 produces a pulse, binary bits of eight printing data 30 are respectively latched in the latching circuit 24. Between T1 and T2, a pulse 37 is produced in the driving signal 36. The AND gate 28 of the driving module 26 then decides whether or not to output the pulse of the corresponding driving signal 36, depending on whether the latched printing data 30 in latching circuit 24 is a "1" or a "0." For example, between T0 and T1, the printing data 30 are (1, 1, 1, 1, 0, 0, 0, 0). When the pulse 37 of the driving signal 36 is produced between T1 and T2, the corresponding transistor switch is on and a current flows through the corresponding heating resistors to heat up the corresponding ink-ejecting chambers (R1, R2, R3, R4) to eject ink spots. Other transistors that are off do not conduct, so the corresponding heating resistors have no current and the corresponding ink-ejecting chambers (R5, R6, R7, R8) are not heated. As a result, no ink spots are elected from those chambers.

Between T1 and T2, printing data is renewed to (1, 1, 1, 1, 1, 0, 0, 0). So, between T2 and T3, a pulse 38 of the driving signal 36 is produced and corresponding ink-ejecting chambers (R1, R2, R3, R4, R5) are heated to eject ink spots. Other ink-ejecting chambers (R6, R7, R8) are not heated, so they do not eject ink spots. The duration of pulses 37 and 38 is the same, but their voltages are different. The voltage of pulse 38 is lower than that of pulse 37 because five ink-ejecting chambers are driven with less energy provided by heating resistor 78 in the second printing process compared to four ink-ejecting chambers driven with more energy in the first printing process. For the same reason, six ink-ejecting chambers are driven with even less energy in the third printing process, so the voltage of pulse 39 is lower than the voltages of both pulses 37 and 38.

Please refer to FIG. 4. FIG. 4 is a timing diagram of a second driving pattern of a prior art ink jet print head. FIG. 3 showed a case where the printing data 30 is concentrated (1, 1, 1, 1, 0, 0, 0, 0). FIG. 4 is different in that the printing data 30 is dispersed (0, 1, 1, 0, 0, 1, 1, 0), (1, 0, 0, 1, 0, 1, 0, 1). Because the prior art only considers the number of ink-ejecting chambers to be driven, the duration and voltages of pulses 47, 48, 49 of the driving signal 36, and the energy provided to heating resistor 78, are the same. In fact, the thermal energy of ink inside the ink-ejecting chamber 78 is influenced by other factors, one being active ink-ejecting chambers in proximity to reserved ink-ejecting chambers. As shown in FIG. 4, the distribution of the reserved ink-ejecting chambers in the first printing process is concentrated, so the thermal energy of ink inside these ink-ejecting chambers is actually higher. However, the distribution of the reserved ink-ejecting chambers in the third printing process is very dispersed, so the thermal energy of the ink inside these ink-ejecting chambers is actually lower. This situation is not considered in the prior art as shown in FIG. 4. Ejected ink spots are still not uniform in size and the printing quality is influenced.

SUMMARY OF THE INVENTION

It is therefore a primary objective of the claimed invention to provide a method for driving an ink jet print head of a printing apparatus to make temperature compensation and provide uniform ink spots.

According to the claimed invention, a method for driving an ink jet print head of a printing apparatus is provided. The ink jet print head includes a plurality of ink cells for containing ink. Each ink cell has a nozzle and a heating element. The method includes calculating an index of each nozzle which will jet ink in an array, corresponding indices of all nozzles which will jet ink in the array to heat-accumulation weightings according to a heat-accumulation weighting table, using the calculation module to calculate a total weight of the array using the heat-accumulation weightings of all the nozzles which will jet ink in the array, and using a driving module to provide energy to heating elements corresponding to the nozzles which will jet ink according to the total weight of the array.

It is an advantage of the claimed invention that the method makes temperature compensation for different heat accumulation weightings and makes ejected ink spots uniform in size to improve printing quality of a printer.

These and other objects and the advantages of the present invention will no doubt become obvious to those of ordinary skill in the art after having read the following detailed description of the preferred embodiment that is illustrated in the various figures and drawings.

BRIEF DESCRIPTION OF THE DRAWINGS

FIGS. 6A and 6B are schematic diagrams of a heat-accumulation weighting table and a heat-dilution weighting table.

DETAILED DESCRIPTION OF THE PREFERRED EMBODIMENT

Figure 5:
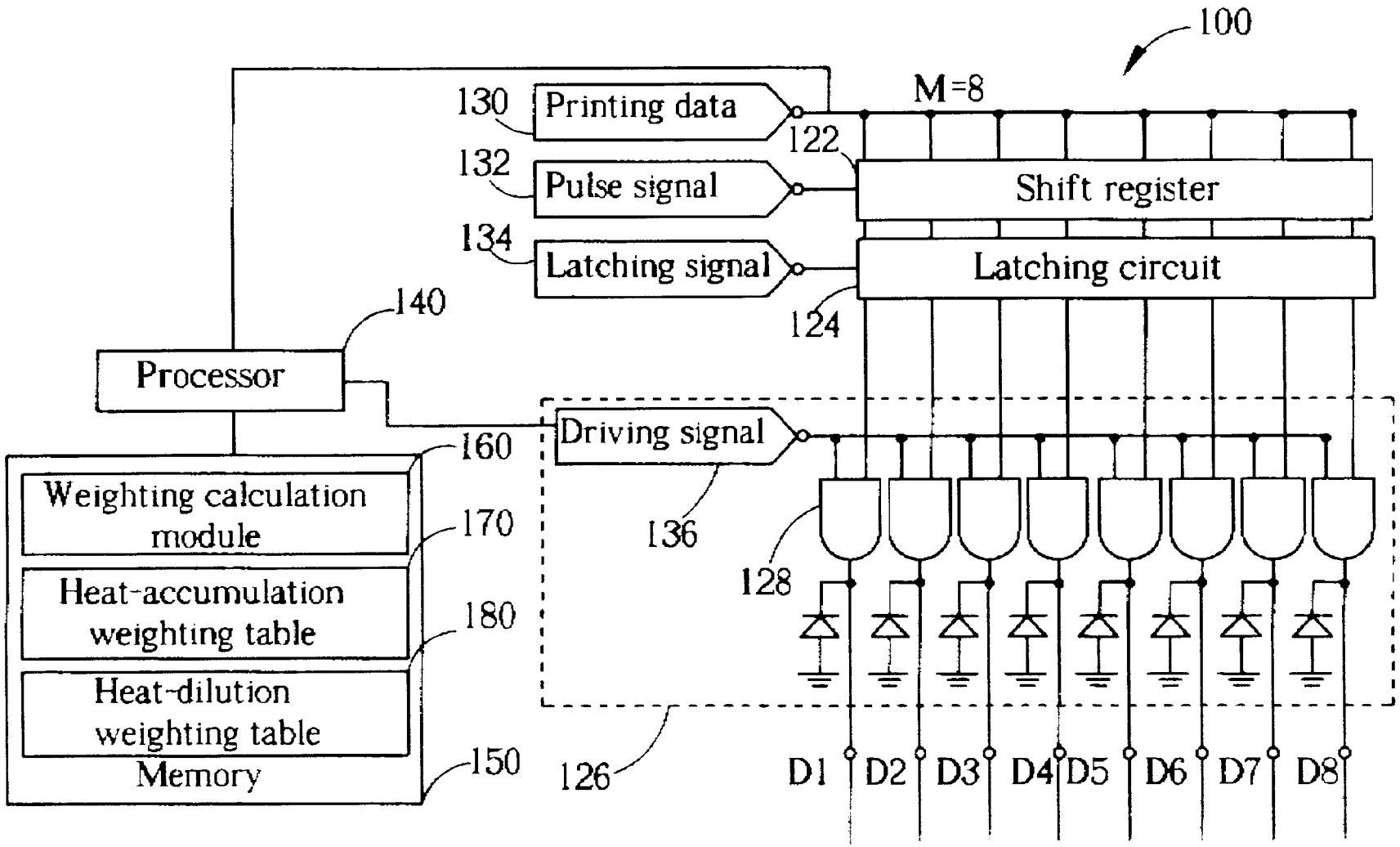
FIG. 5 is a schematic diagram of an ink jet print head according to the present invention.

Please refer to FIG. 5. FIG. 5 is a schematic diagram of a control circuit 100 in an ink jet print head according to one embodiment of the present invention. The control circuit 100 includes a shift register 122, a latching circuit 124, a processor 140, a memory 150 and a driving module 126. The shift register 122 receives printing data 130 transmitted from a printing apparatus. The printing data 130 is binary digital data, which is either 0 or 1. The latching circuit 124 latches and stores the printing data 130 in the latching circuit 124 according to a latch signal 134. The processor 140 controls all operations of the control circuit 100, including processing data and executing programs. The memory 150 stores a heat-accumulation weighting table 170, a heat-dilution weighting table 180 and a weighting calculation module 160. The heat-accumulation weighting table 170 defines a heat-accumulation weighting of a jetting nozzle according to the distribution of adjacent jetting nozzles. The heat-dilution weighting table 180 defines a heat-dilution weighting of a non-jetting nozzle according to the distribution of adjacent non-jetting nozzles. The weighting calculation module 160 is a program capable of calculating the heat-accumulation weightings of all jetting nozzles and the heat-dilution weightings of all non-jetting nozzles in the print data of each printing process and obtaining a total weighting sum. The total weighting sum will be provided to the processor 140 for determining a proper driving signal 136 to the driving module 126. The driving module 126 comprises a plurality of AND gates 128. The AND gates 128 provide driving signals to the heating resistors of the jetting nozzles so as to generate bubbles and jet ink drops from the nozzles.

Please refer to FIGS. 6A and 6B. FIGS. 6A and 6B are schematic diagrams of a heat-accumulation weighting table 170 and a heat-dilution weighting table 180 according to this embodiment. The heat-accumulation weighting table 170 contains three rows: a heat-accumulation index (m) 172, a heat-accumulation weighting (W(m)) 174 and a heat-accumulation weighting value 176. The weighting calculation module 160 calculates the heat-accumulation weightings of all jetting nozzles and non-jetting nozzles to obtain a value indicating the energy accumulation condition of the jetting nozzles in this printing process. Since the energy accumulation condition is closely related to the number of consecutive jetting nozzles, each consecutive jetting nozzle is defined a heat-accumulation index m, and is assigned a corresponding heat-accumulation weighting W(m). The first jetting nozzle is defined a heat-accumulation index 1, and is assigned a heat-accumulation weighting W(1)=a; the second consecutive jetting nozzle is defined a heat-accumulation index 2, and is assigned a heat-accumulation weighting W(2)=b; the third consecutive jetting nozzle is defined a heat-accumulation index 3, and is assigned a heat-accumulation weighting W(3);=c; the fourth consecutive jetting nozzle is defined a heat-accumulation index 4, and is assigned a heat-accumulation weighting W(4)=d, . . . , etc. The value of the heat-accumulation weighting W(m) for each consecutive jetting nozzle is determined by estimation and experimental measurements. In this embodiment, W(1)=a=1, W(2)=b=2, W(3)=c=3, W(4)=d=4, W(5)=e=5, . . . etc. In a simplified example, if there are 10 nozzles arranged in a line and three adjacent nozzles of which are desired to jet ink drops, it is regarded that there are three consecutive jetting nozzles. These jetting nozzles will be defined as heat-accumulation index 1, 2, and 3 respectively. The heat-accumulation weightings 174 of the first jetting nozzle, the second consecutive jetting nozzle, and the third consecutive jetting nozzle are respectively represented as a, b, c. According to the heat-accumulation weighting table 170, the heat-accumulation weighting sum will be $Wtotal=W(1)+W(2)+W(3)=a+b+c=6$. The heat-accumulation weighting sum Wtotal=6 indicates the heat accumulation condition of the print data in this printing process.

Similarly, the heat-dilution weighting table 180 has three rows: a heat-dilution index (k) 182, a heat-dilution weighting (C(k)) 184 and a heat-dilution weighting value 186. The weighting calculation module 160 calculates the heat-dilution weightings of all non-jetting nozzles to obtain a value indicating the energy dilution condition of the non-jetting nozzles in this printing process. The energy dilution condition is also closely related to the number of consecutive non-jetting nozzles, so each consecutive non-jetting nozzle is defined by a heat-dilution index k, and is assigned a heat-dilution weighting C(k). The first non-jetting nozzle is defined by a heat-dilution index 1, and is assigned a heat-dilution weighting C(1)=A; the second consecutive non-jetting nozzle is defined by a neat-dilution index 2, and is assigned a heat-dilution weighting C(2)=B; the third consecutive non-jetting nozzle is defined by a heat-dilution index 3, and is assigned a heat-dilution weighting C(3)=C; the fourth consecutive non-jetting nozzle is defined by a heat-dilution index 4, and is assigned a heat-dilution weighting C(4)=D, . . . , etc. The value of the heat-dilution weighing W(m) for each consecutive non-jetting nozzle is determined by estimation and experimental measurements. In this embodiment, C(1)=A=0, C(2)=B=1, C(3)=C=1, C(4)−D−2, C(5)=E=2, . . . , etc. In a simplified example, if there are 10 nozzles arranged in a line and three adjacent nozzles of which are desired not to jet ink drops, it is regarded that there are three consecutive non-jetting nozzles. These non-jetting nozzles will be defined as heat-dilution index 1, 2, and 3 respectively. The heat-dilution weightings 184 of the first non-jetting nozzle, the second consecutive non-jetting nozzle, and the third consecutive non-jetting nozzle are respectively A, B, C. According to the heat dilution weighting table 180, the heat-dilution weighting sum will be $Ctotal=C(1)+C(2)+C(3)=A+B+C=2$. The heat-dilution weighting sum Ctotal=2 indicates a heat dilution condition of the print data in this printing process.

Figure 7:
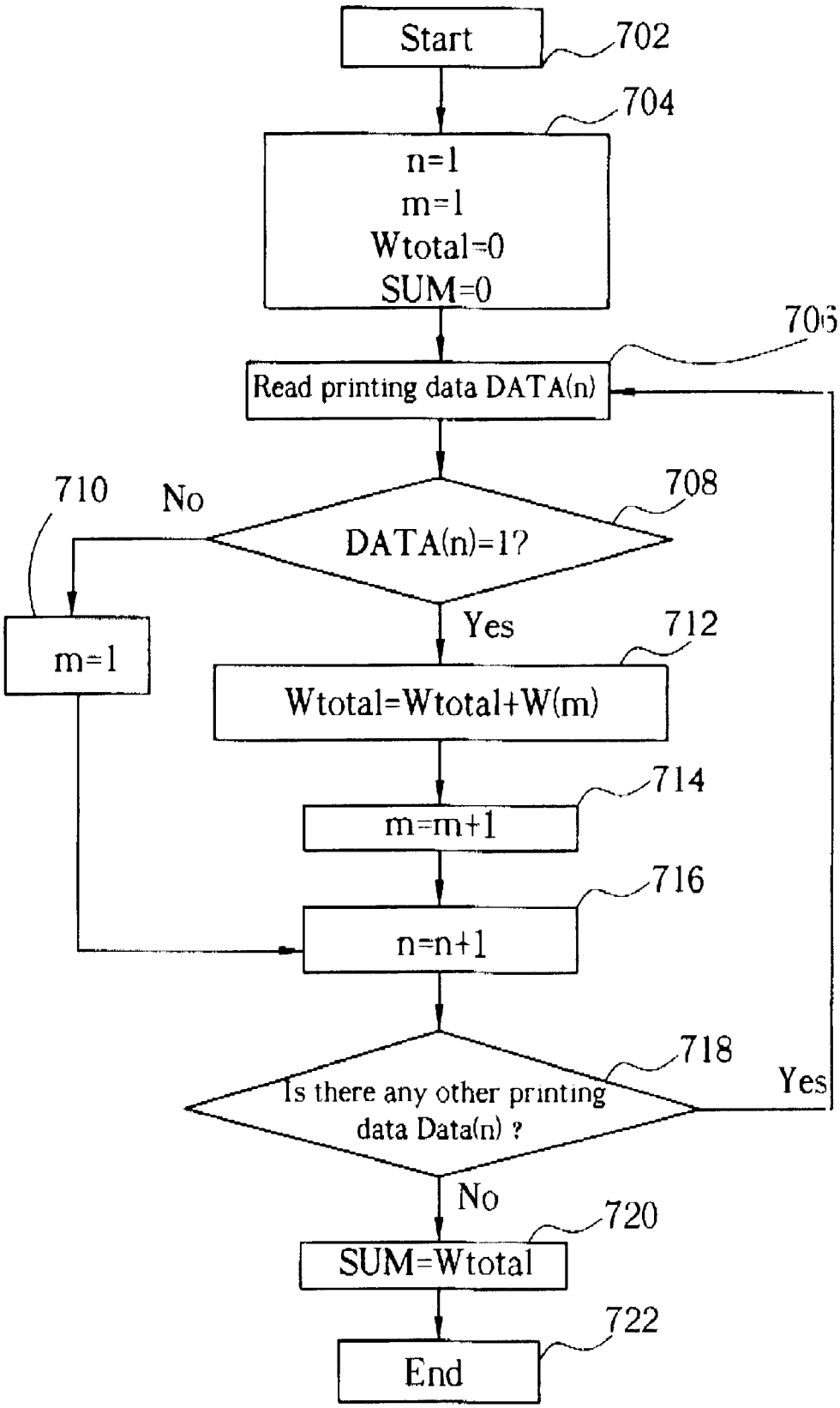
FIG. 7 is a flow chart of an embodiment of a total weighting calculation according to the present invention.

Please refer to FIG. 7. FIG. 7 is a flow chart illustrating the calculation of the heat-accumulation sum according to this embodiment. This flow chart is suitable for estimating the heat-accumulation effect for ink jet print heat with the linear nozzle arrangement. It should be noted that more sophisticated algorithms may also be adopted considering various conditions, and applications.

step 702: start;

step 704: printing data index n is set to 1; heat-accumulation index m is set to 1; heat-accumulation weighting sum Wtotal is set to 0; total weighting sum SUM is set to 0;

step 706; read printing data Data(n);

step 708: if printing data Data(n) is 1, go to step 712, if not, go to step 710;

step 710: heat-accumulation index m is set to 1, go to step 716;

step 712: add the heat accumulation weighting W(m) to the heat-accumulation weighting sum Wtotal;

step 714: add 1 to the heat-accumulation index m;

step 716: add 1 to the printing data index n;

step 718: if there is more printing data Data(n) in the sequence, go to step 706, if not, go to step 720;

step 720: set total weighting sum SUM as heat-accumulation weighting sum Wtotal;

step 722: end.

For easier understanding of this embodiment, a simplified example is given below. Assume an ink jet print head has eight nozzles arranged in a line, signals received by each nozzle are expressed by:

Data(1), Data(2), Data(3), Data(4), Data(5), Data(6), Data(7), Data(8).

If the signal received by a nozzle is 1, the nozzle is desired to jet ink. If the signal received by a nozzle is 0, the nozzle is desired not to jet ink.

Example 1:

Data(1)=1;

Data(2)=1;

Data(3)=1;

Data(4)=1;

Data(5)=0;

Data(6)=0;

Data(7)=0;

Data(8)=0;

$$SUM=a+b+c+d=1+2+3+4=10$$

according to the heat-accumulation weighting table 170 in FIG. 6A and the flow chart in FIG. 7.

Example 2:

Data(1)=0;

Data(2)=1;

Data(3)=1;

Data(4)=0;

Data(5)=0;

Data(6)=1;

Data(7)=1;

Data(8)=0;

$$SUM=a+b+a+b=1+2+1+2=6$$

according to the heat-accumulation weighting table 170 in FIG. 6A and the flow chart in FIG. 7.

Example 3:

Data(1)=1;

Data(2)=0;

Data(3)=0;

Data(4)=1;

Data(5)=0;

Data(6)=1;

Data(7)=0;

Data(8)=1;

$$SUM=a+a+a+a=1+1+1+1=4$$

according to the heat-accumulation weighting table 170 in FIG. 6A and the flow chart in FIG. 7.

In these three examples, four nozzles are driven to jet ink in the printing process, but with different nozzle distributions. The first printing data 30 is (1, 1, 1, 1, 0, 0, 0, 0). The second printing data 30 is dispersed (0, 1, 1, 0, 0, 1, 1, 0). The third printing data 30 is even more dispersed (1, 0, 0, 1, 0, 1, 0, 1). The weighting calculation module 160 of this embodiment calculates the total weighting SUM to have three different values (10, 6, and 4). Therefore, the processor 140 may use three different driving signals 136 to drive the driving module 126.

Figure 8:
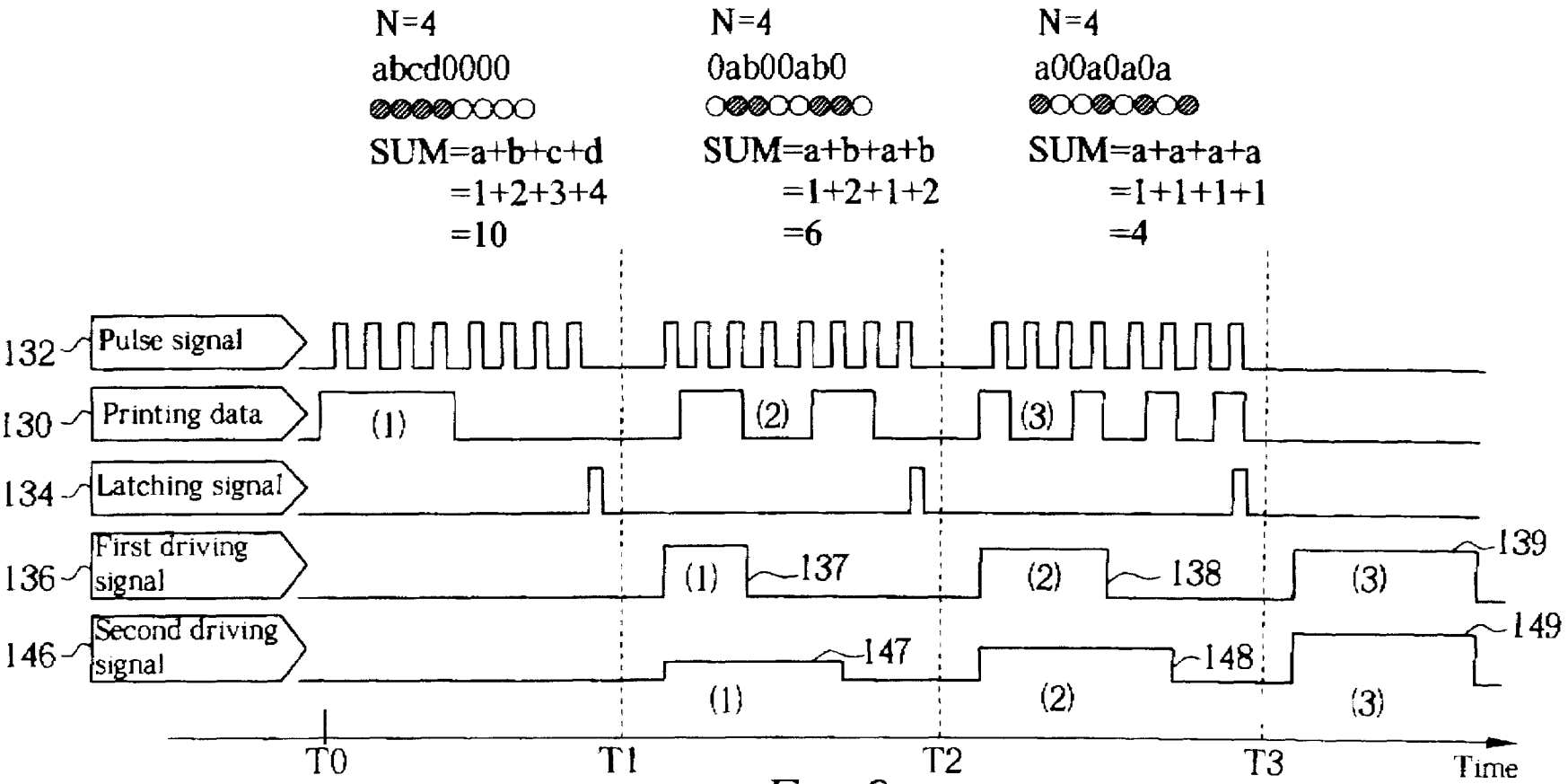
FIG. 8 is a timing diagram of driving signals of an ink jet print head according to the present invention.

FIG. 8 is a timing diagram of three different driving signals in this embodiment. When there are four nozzles to be driven in each printing process, the larger the total weighting SUM is, the more obvious the heat accumulation effect is. Therefore, energy of the corresponding driving signal is smaller (see pulses 137 and 147). In contrast, if the total weighting SUM is smaller, the heat accumulation effect will be less obvious, and the energy of the corresponding driving signal should be larger (see pulses 139 and 149).

FIG. 8 illustrates two different kinds of driving signals, a first driving signal and a second driving signal. Both the first driving signal and the second driving signal are suitable in this embodiment. The only difference is the form in which they generate energy to the nozzles. Pulses 137, 138 and 139 of the first driving signal 136 have the same voltage but different duration so as to generate different energy levels. Pulses 147, 148 and 149 of the second driving signal 146 have the same duration but different voltage so as to generate different energy levels. There may be various forms of driving signals so long as they are capable of generating different energy levels to the jetting nozzles.

In addition, the SUM may also be divided into several sections for determining proper driving signals. For example, when SUM is smaller than or equal to 5 (SUM<= 5), a first driving signal is used; when SUM is larger than 5, and smaller than or equal to 9 (5<SUM<=9), a second driving signal is used; when SUM is larger than 9 (9<SUM), a third driving signal is used. The first, second or third driving signal may have different durations or voltages to provide different energy levels to the jetting nozzles.

Figure 9:
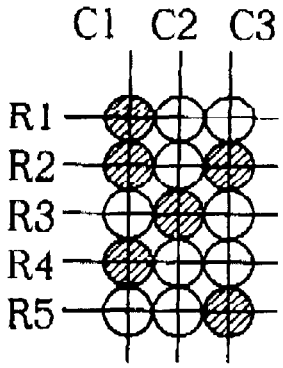
FIG. 9 is a schematic diagram of the total weighting calculation according to the present invention used in a first matrix ink jet print head.
Figure 10:
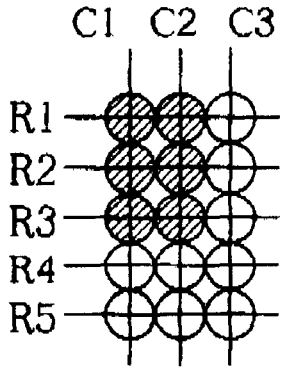
FIG. 10 is a schematic diagram of the total weighting calculation according to the present invention used in a second matrix ink jet print head.

In the above embodiment, the present invention is applied to an ink jet print head where the nozzles are arranged in a linear form. Meanwhile, the present invention may also be applied to other ink jet print heads where the nozzles are arranged in a matrix form. FIG. 9 and FIG. 10 are schematic diagrams illustrating the calculation of a total weighting sum SUM in a second embodiment where the nozzles are arranged in a matrix form on the print head. To simplify the illustration, only heat-accumulation is considered when calculating the total weighting sum SUM in FIG. 9 and FIG. 10. When nozzles are arranged in a matrix, these nozzles can be regarded as composed of a plurality of columns (C1, C2, C3) and a plurality of rows (R1, R2, R3, R4, R5). Nozzles in each column or row can be considered as linearly arranged. Therefore, the weighting calculation procedure in FIG. 7 can be applied. Weighting calculation results of each column and each row are added to generate a total weighting sum SUM as indicated in the calculation procedures 210 and 220 in FIG. 9 and FIG. 10. In FIG. 9 and FIG. 10, the numbers of jetting nozzles in both embodiments are six. When the nozzle distribution is dispersed as illustrated in FIG. 9, a smaller total weighting sum SUM (which equals 13) is obtained. When the nozzle distribution is more concentrated as illustrated in FIG. 10, a larger total weighting sum SUM (which equals 21) is calculated.

Figure 11:
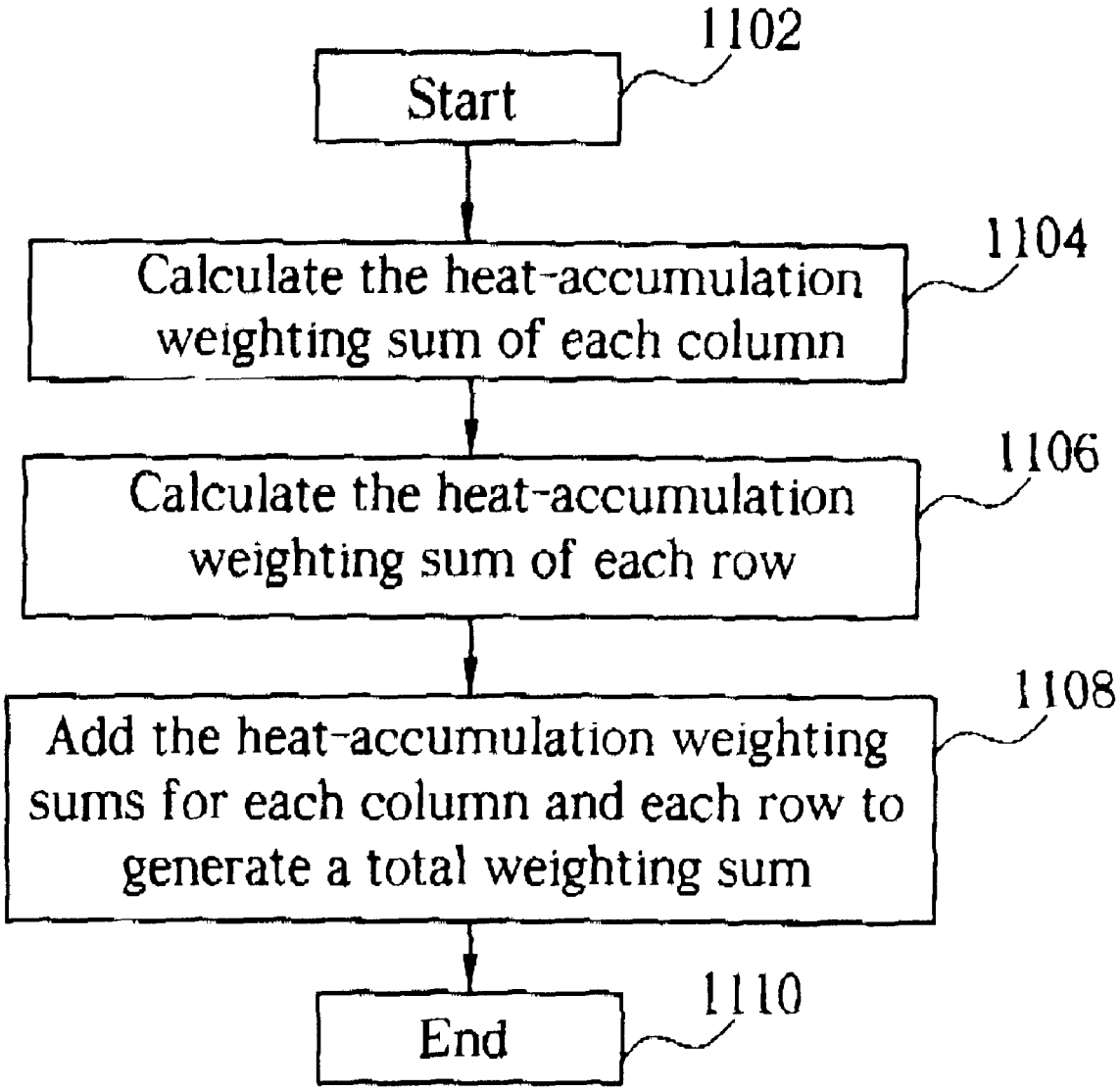
FIG. 11 is a flow chart of the total weighting calculation according to the present invention used in a first matrix ink jet print head.

FIG. 11 is a flow chart illustrating the calculation of the total weighting sum SUM in an ink jet print head where the nozzles are arranged in a matrix form. The calculation steps include:

- step 1102: start;
- step 1104: calculating a heat-accumulation weighting sum of each column;
- step 1106: calculating a heat-accumulation weighting sum of each row;
- step 1108: add up the heat-accumulation weighting sums of each column and each row to generate a total weighting sum;
- step 1110: end.

Figure 12:
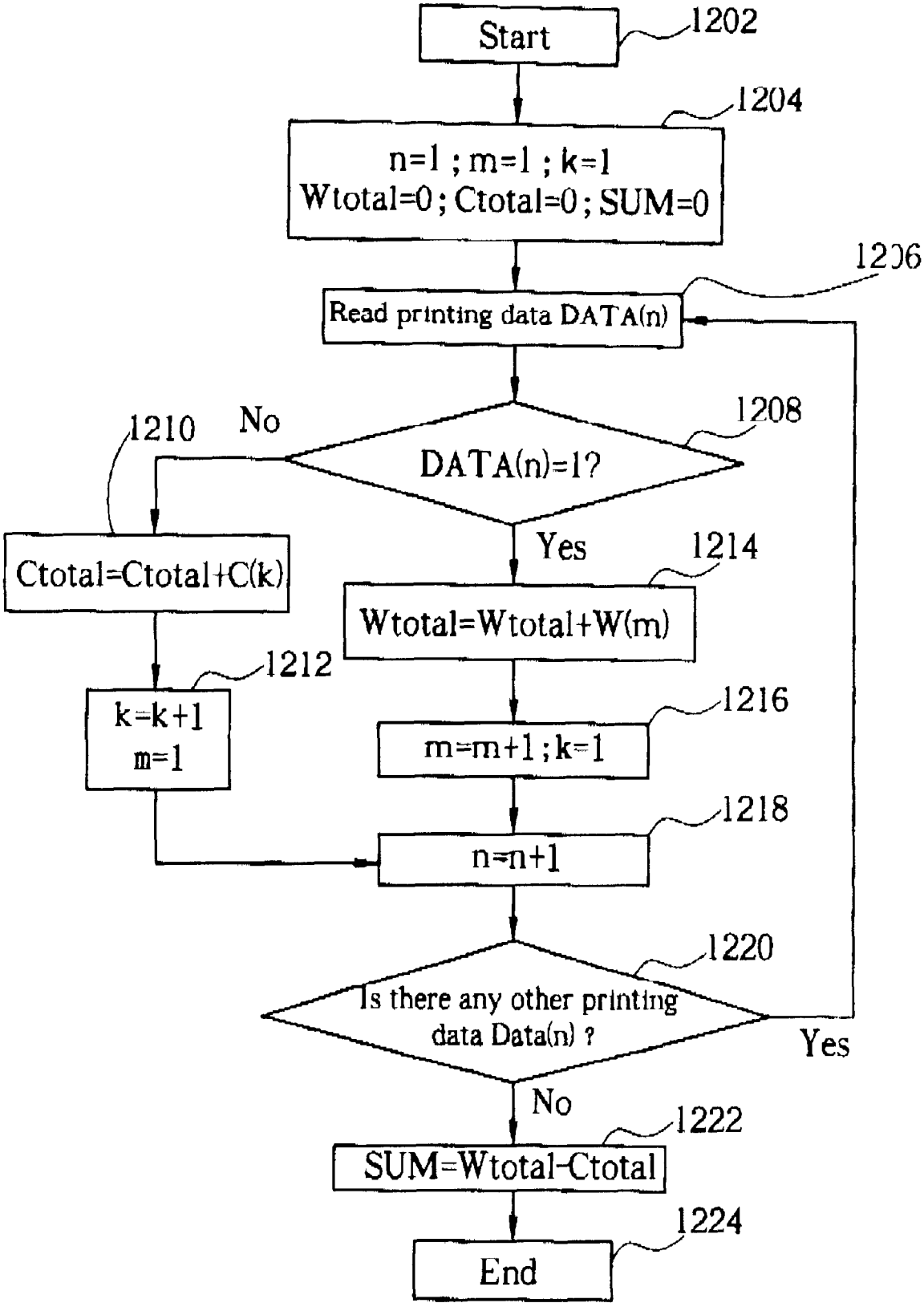
FIG. 12 is a flow chart of the total weighting calculation according to the present invention used in a second matrix ink jet print head.

Please refer to FIG. 12. FIG. 12 is a flow chart illustrating the total weighting sum calculation of another embodiment according to the present invention. In addition to the heat-accumulation weighting sum, this embodiment considers the heat-dilution weighting sum as well. The stops include:

- step 1202: start;
- step 1204: printing data index n set to 1; heat-accumulation index m set to 1; heat-dilution index k set to 1; heat-accumulation weighting sum Wtotal set to 0; heat-dilution weighting sum Ctotal set to 0; total weighting sum SUM set to 0;
- step 1206: read printing data DATA(n);
- step 1208: if DATA (n) is 1, go to step 1214; if not, go to step 1210;
- step 1210: according to the heat-dilution weighting table 130 (FIG. 6B), add heat-dilution weighting C(k) to heat-dilution weighting sum Ctotal;
- step 1212: add 1 to heat-dilution index k, set heat-accumulation index m to 1, go to step 1218;
- step 1214: add heat-accumulation weighting W(m) to heat-accumulation weighting sum Wtotal;
- step 1216: add 1 to heat accumulation index m, set heat-dilution index k to 1;
- step 1218: add 1 to printing data index n;
- step 1220: if there is other printing data, go to step 1206; if not, go to step 1222;
- step 1222: subtract heat-dilution weighting Ctotal from heat-accumulation weighting Wtotal and save the difference as total weighting sum SUM;
- step 1224: end.

A simplified example is illustrated below. Assume an ink jet print head has eight nozzles arranged in a line, each signal received by the nozzle being expressed as:

Data(1), Data(2), Data(3), Data(4), Data(5), Data(6), Data (7) and Data(8).

If the signal received by a nozzle is 1, the nozzle is desired to jet ink. If the signal received by a nozzle is 0, the nozzle is desired not to jet ink.

Example one:

Data(1)=1,
Data(2)=1,
Data(3)=1,
Data(4)=1,
Data(5)=0,
Data(6)=0,
Data(7)=0,
Data(8)=0

From the heat-accumulation weighting table 170 in FIG. 6A and the flow chart in FIG. 12, $$\begin{aligned} SUM &= Wtotal - Ctotal \\ &= (a+b+c+d) - (A+B+C+D) \\ &= (1+2+3+4) - (0+1+1+2) \\ &= 6 \end{aligned}$$

Example two:

Data(1)=0,
Data(2)=1,
Data(3)=1,
Data(4)=0,
Data(5)=0,
Data(6)=1, Data(7)=1, Data(8)=0, From the heat-accumulation weighting table 170 in FIG. 6A and the flow chart in FIG. 12, $$\begin{aligned} SUM &= Wtotal - Ctotal \\ &= (a+b+c+d)-(A+B+C+D) \\ &= (1+2+1+2)-(0+0+1+0) \\ &= 5 \end{aligned}$$

Example three:

Data(1)=1,

Data(2)=0,

Data(3)=0,

Data(4)=1,

Data(5)=0,

Data(6)=1,

Data(7)=0,

Data(8)=1,

From the heat-accumulation weighting table 170 in FIG. 6A and the flow chart in FIG. 12, $$\begin{aligned} SUM &= Wtotal - Ctotal \\ &= (a+b+c+d)-(A+B+C+D) \\ &= (1+1+1+1)-(0+1+0+0) \\ &= 3 \end{aligned}$$

This embodiment considers both the heat-accumulation effect and the heat-dilution effect, thus the total weighting sum SUM better represents the energy accumulation condition of the nozzles on the print head in this printing process. A better determination of proper driving signals can be achieved.

Figure 13:
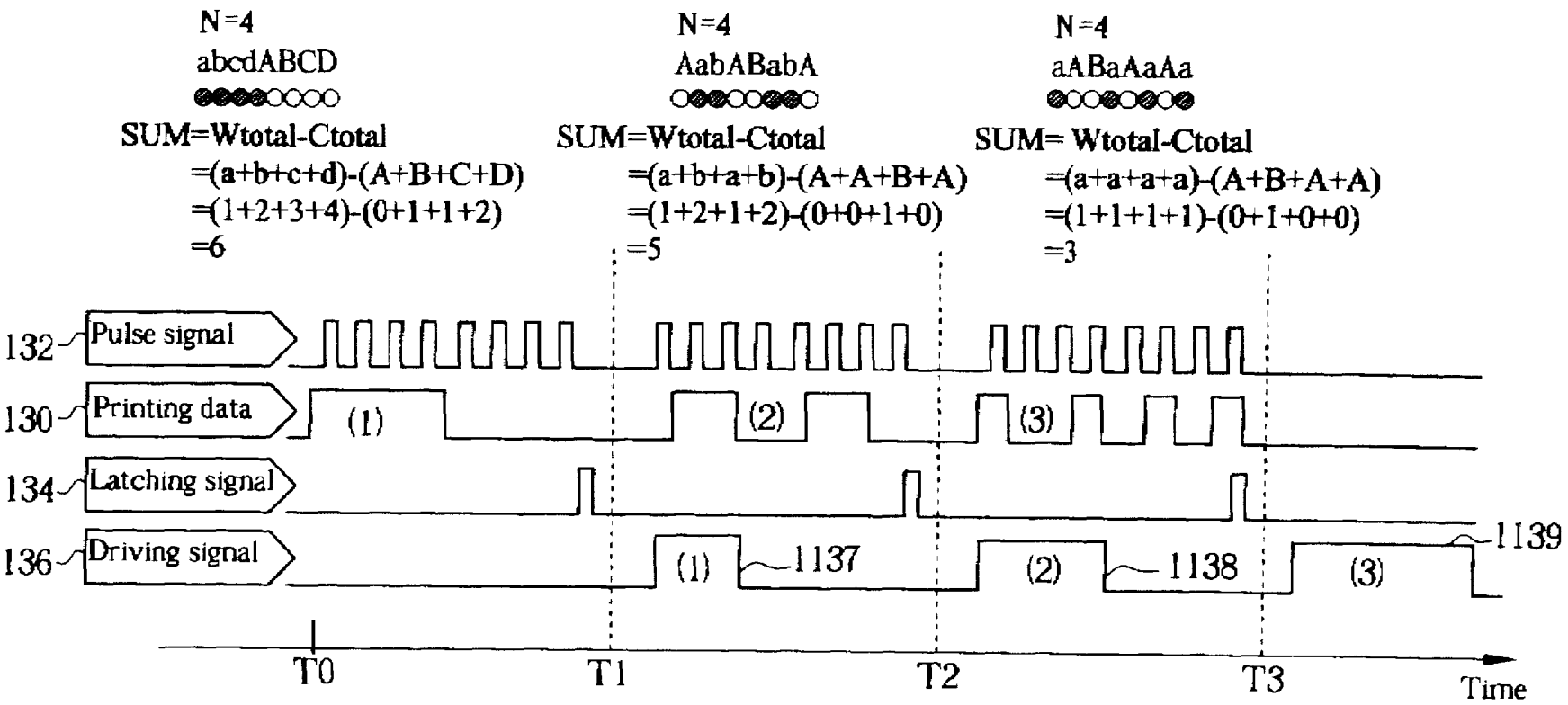
FIG. 13 is a timing diagram of driving signals in a first matrix ink jet print head.

FIG. 13 is a timing diagram illustrating the driving signal of this embodiment according to the present invention. Printing data 130 in FIG. 13 is the same as that in FIG. 8. However, in this embodiment the weighting calculation module 160 considers both the heat-dilution effect and the heat-accumulation effect of the nozzles. After the heat-accumulation weighting sum Wtotal and the heat-dilution weighting sum Ctotal are calculated, the total weighting sum SUM are obtained (6, 5, and 3). Driving signals in these three conditions are different, represented by pulses 1137, 1138 and 1139, respectively. The total weighting sum of the first printing data 130 (1, 1, 1, 1, 0, 0, 0, 0) is larger, so the energy level of the pulse 1137 is smaller. The total weighting sum of the third printing data 130 (1, 0, 0, 1, 0, 1, 0) is smaller, so the energy level of the pulse 1139 is larger.

Figure 14:
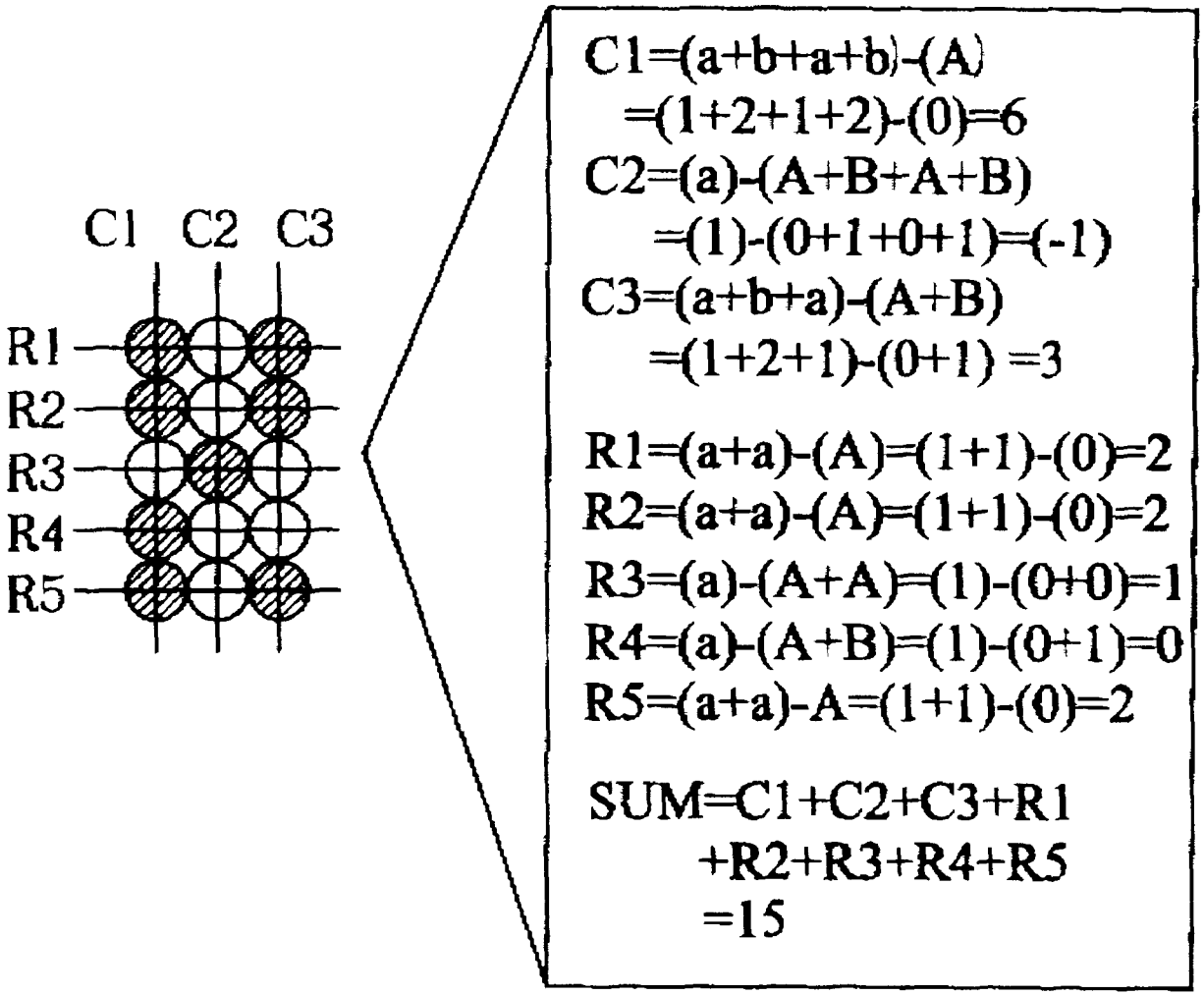
FIG. 14 is a schematic diagram of the total weighting calculation according to the present invention used in a second matrix ink jet print head.

FIG. 14 is a schematic diagram illustrating the calculation of the total weighting sum of another embodiment where the ink jet print head has nozzles arranged in a matrix form. As shown, the heat-accumulation weighting sum and the heat-dilution weighting sum of the nozzles are considered when calculating total weighting sum. The nozzles of the ink jet print head can be divided into a plurality of columns (C1, C2, C3) and a plurality of rows (R1, R2, R3, R4, R5). Each column and row can be respectively considered as nozzles arranged in a linear way, and the total weighting sum of each column and row are calculated as indicated in FIG. 12. The total weighting sums of all columns and rows are added up to generate a total weighting sum SUM.

Since SUM is defined as Wtotal subtracts Ctotal (*SUM=Wtotal−Ctotal*), the value of SUM may be negative. This will not cause any problem if SUM is divided into several ranges for determining a proper driving signal. For example, if SUM <=0, a first driving signal is used; if 0<SUM<=10, a second driving signal is used; if 10<SUM<=20, a third driving signal is used; if 20<SUM, a fourth driving signal is used. The first, the second, the third, and the fourth driving signals may have different duration or voltage to provide different energy levels to the heating devices so as to jet ink drops out of the nozzles on the print head.

Figure 1:
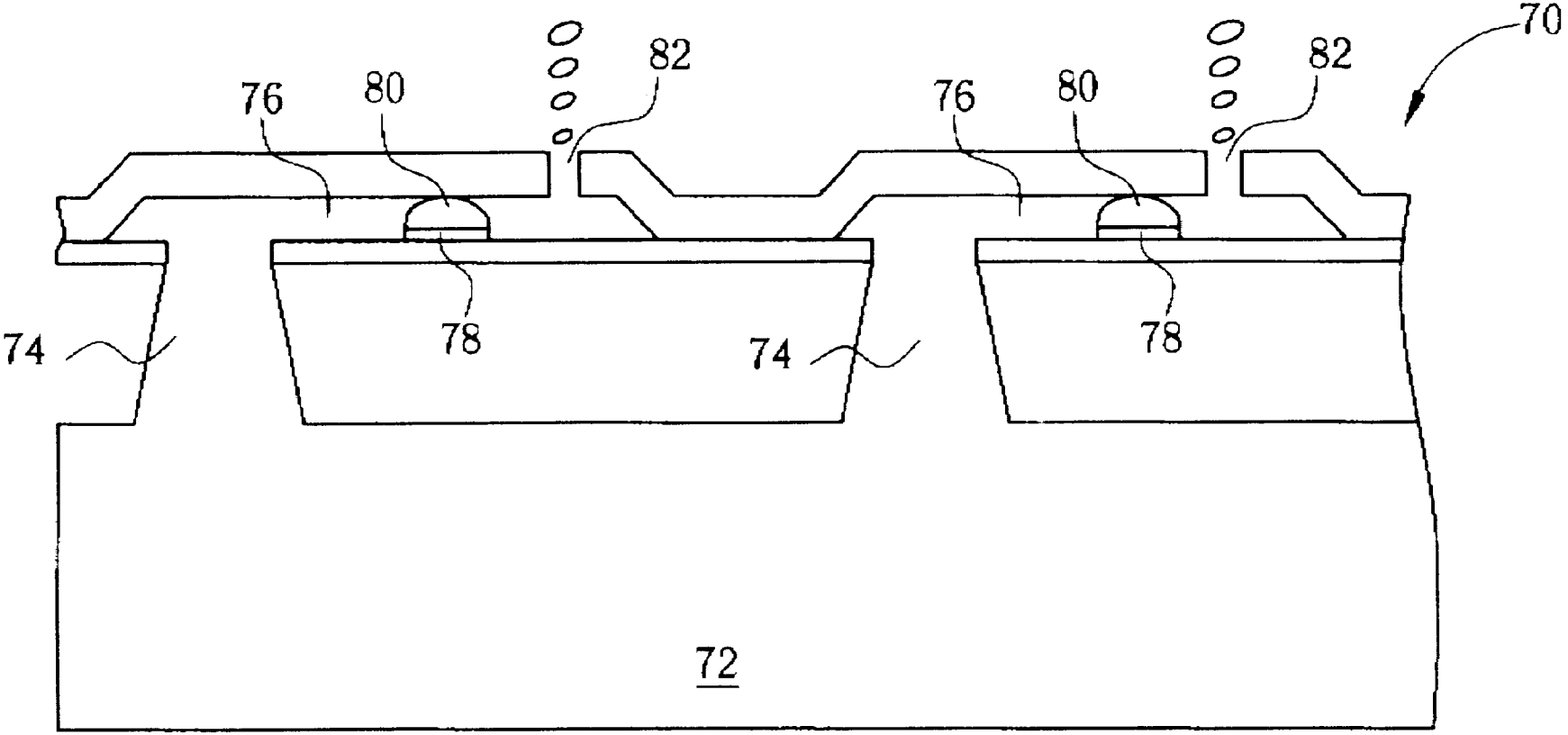
Fig. 1 Prior art
FIG. 1 is a schematic diagram of a prior art ink jet print head.
Figure 2:
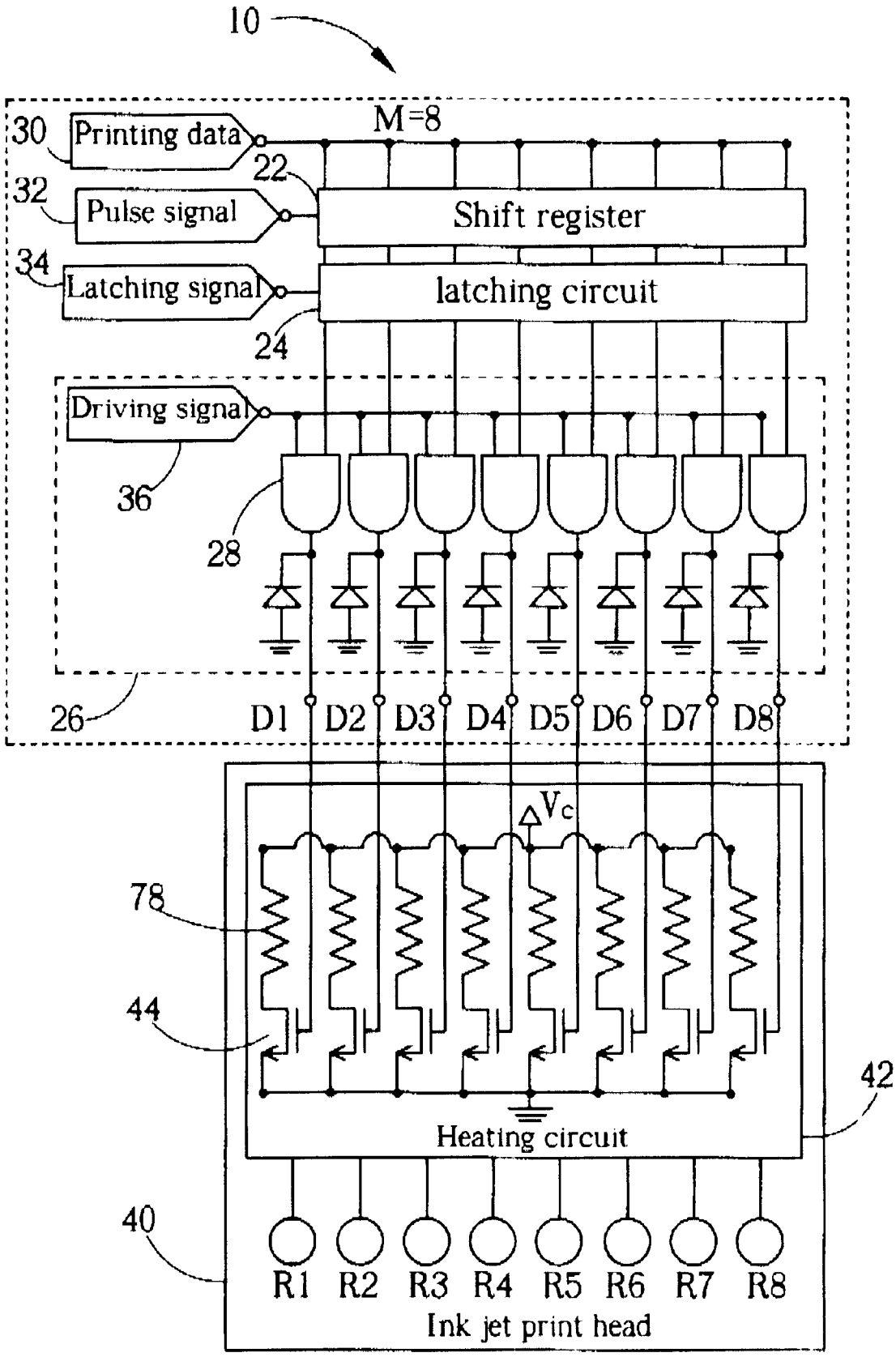
Fig. 2 Prior art
FIG. 2 is a schematic diagram of a driving circuit in a prior art ink jet print head.
Figure 3:
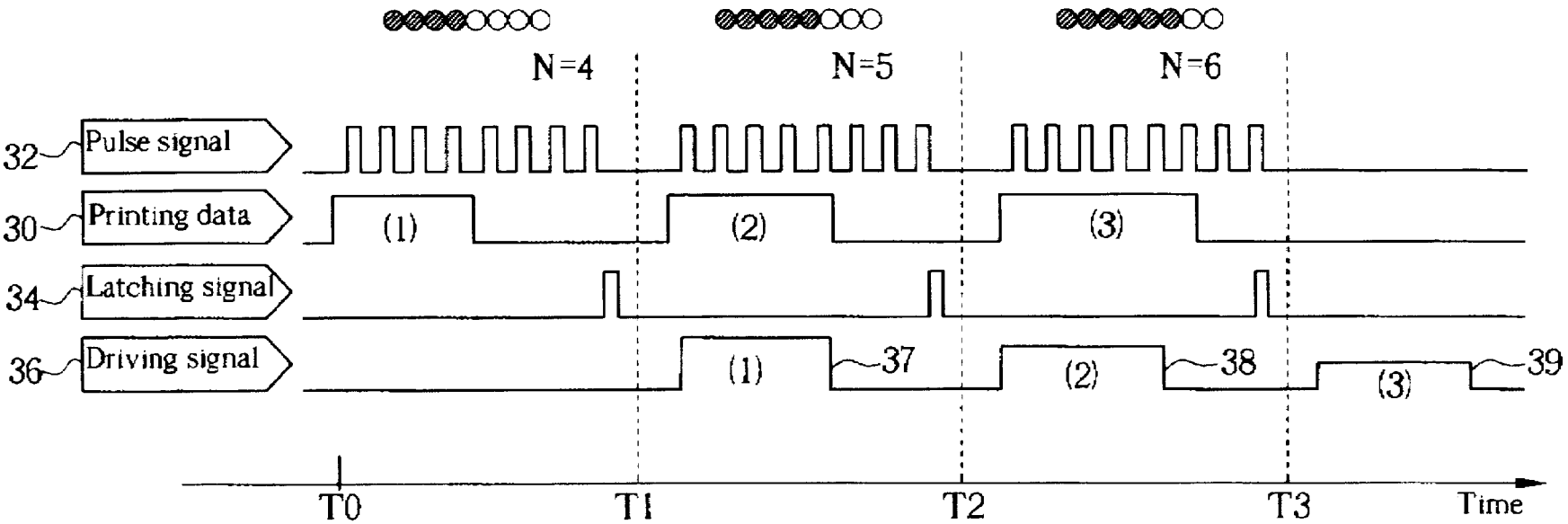
Fig. 3 Prior art
FIG. 3 is a timing diagram of a first driving signal of a prior art ink let print head.
Figure 4:
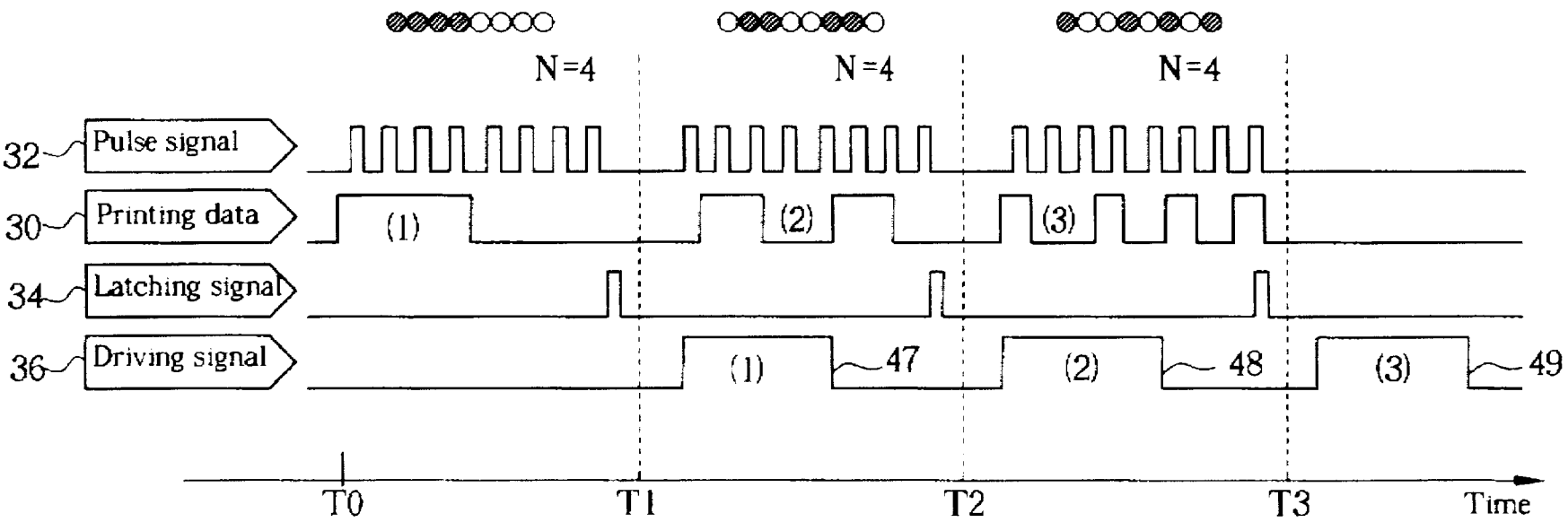
Fig. 4 Prior art
FIG. 4 is a timing diagram of a second driving signal of a prior art ink jet print head.

In FIG. 1 the heating devices (the heating resistor 78) are installed inside the ink-ejecting chambers. It is noted that the heating devices may also be installed outside the ink-ejecting chambers to heat up ink inside the ink-ejecting chambers so as to jet ink drops out of the nozzles.

The prior art considers only the number of jetting nozzles, but does not consider the distribution of the jetting nozzles to determine proper driving signals. The present invention considers the distribution of the jetting nozzles by calculating the heat-accumulation effect of jetting nozzles and the heat-dilution effect of non-jetting nozzles, so a better determination of proper driving signals can be achieved. The present invention makes the thermal distribution of different ink-ejecting chambers in the ink jet print head more uniform, makes the sizes of ejected ink drops uniform, and leads to better printing quality.

Those skilled in the art will readily observe that numerous modifications and alterations of the present invention may be made while retaining the teachings of the invention. Accordingly, the above disclosure should be construed as limited only by the metes and bounds of appended claims.

What is claimed is:

1. A method for driving an ink jet print head of a printing apparatus, the ink jet print head comprising a plurality of ink cells for containing ink, each ink cell comprising a nozzle and a heating element, the method comprising:

using a calculation module to calculate an index of each nozzle which will jet ink in an array, wherein:

if the nozzle is to jet ink, and a directly preceding nozzle is not to jet ink, then the index of the nozzle is reset;

if the nozzle is to jet ink, and the directly preceding nozzle is also to jet ink, then the index of the nozzle is calculated based on an index of the directly preceding nozzle;

corresponding indices of all nozzles which will jet ink in the array to heat-accumulation weightings according to a heat-accumulation weighting table, the heat-accumulation weightings corresponded by the indices of all the nozzles which will jet ink having at least two different values;

using the calculation module to calculate a total weight of the array using the heat-accumulation weightings of all the nozzles which will jet ink in the array; and using a driving module to provide energy to heating elements corresponding to the nozzles which will jet ink according to the total weight of the array.

2. The method of claim 1 wherein if both the nozzle and the directly preceding nozzle are to jet ink, the index of the nozzle is incremented from the index of the directly preceding nozzle.

3. The method of claim 2 wherein a greater index corresponds to an equal or greater heat-accumulation weighting.

4. The method of claim 1 wherein the total weight of the array is a sum of the heat-accumulation weightings of all the nozzles which will jet ink in the array.

5. The method of claim 1 wherein a greater total weight corresponds to less energy provided to the heating elements.

6. The method of claim 1 wherein the energy provided by the driving module is delivered by a pulse, a duration of the pulse depending an the total weight.

7. The method of claim 1 wherein the energy provided by the driving module is delivered by a pulse, a voltage of the pulse depending on the total weight.

8. The method of claim 1 wherein the heating element is a heating resistor.

9. A method for driving an ink jet print head of a printing apparatus, the ink jet print head comprising a plurality of ink cells for containing ink, each ink cell comprising a nozzle and a heating element, the method comprising:

using a calculation module to calculate an index of each nozzle in an array, wherein:

if the nozzle is to jet ink, and a directly preceding nozzle is not to jet ink, then the index of the nozzle is reset;

if the nozzle is to jet ink, and the directly preceding nozzle is also to jet ink, then the index of the nozzle is calculated based on an index of the directly preceding nozzle;

if the nozzle is not to jet ink, and the directly preceding nozzle is to jet ink, then the index of the nozzle is reset;

if the nozzle is not to jet ink, and the directly preceding nozzle is also not to jet ink, then the index of the nozzle is calculated based on an index of the directly preceding nozzle;

corresponding indices of all nozzles which will jet ink in the array to heat-accumulation weightings according to a heat-accumulation weighting table, the heat-accumulation weightings corresponded by the indices of all the nozzles which will jet ink having at least two different values;

corresponding indices of all nozzles which will not jet ink in the array to heat-dilution weightings according to a heat-dilution weighting table;

using the calculation module to calculate a total weight of the array using the heat-accumulation weightings of all the nozzles which will jet ink and the heat-dilution weightings of all the nozzles which will not jet ink in the array; and using a driving module to provide energy to heating elements corresponding to the nozzles which will jet ink according to the total weight of the array.

10. The method of claim 9 wherein if both the nozzle and the directly preceding nozzle are to jet ink, or neither the nozzle nor the directly preceding nozzle is to jet ink, the index of the nozzle is incremented from the index of the directly preceding nozzle.

11. The method of claim 10 wherein a greater index corresponds to an equal or greater heat-accumulation weighting or heat-dilution weighting.

12. The method of claim 9 wherein the total weight of the array is a difference of a sum of the heat-accumulation weightings of all the nozzles which will jet ink in the array and a sum of the heat-dilution weightings of all the nozzles which will not jet ink in the array.

13. A method for driving an ink jet print head of a printing apparatus, the ink jet print head comprising a plurality of ink cells for containing ink, each ink cell comprising a nozzle and a heating element, the method comprising:

using a calculation module to calculate a row index and a column index of each nozzle which will jet ink in a two-dimensional matrix, the two-dimensional matrix having a plurality of rows and a plurality of columns, the nozzle being positioned in a row and in a column, wherein:

if the nozzle is to jet ink, and a directly preceding nozzle in the row is not to jet ink, then the row index of the nozzle is reset;

if the nozzle is to jet ink, and the directly preceding nozzle in the row is also to jet ink, then the row index of the nozzle is calculated based on a row index of the directly preceding nozzle;

if the nozzle is to jet ink, and a directly preceding nozzle in the column is not to jet ink, then the column index of the nozzle is reset;

if the nozzle is to jet ink, and the directly preceding nozzle in the column is also to jet ink, then the column index of the nozzle is calculated based on a column index of the directly preceding nozzle;

corresponding row indices of all nozzles which will jet ink in the matrix to heat-accumulation weightings according to a heat-accumulation weighting table, the heat-accumulation weightings corresponded by the row indices of all the nozzles which will jet ink having at least two different values;

corresponding column indices of all the nozzles which will jet ink in the matrix to heat-accumulation weightings according to the heat-accumulation weighting table;

using the calculation module to calculate a total weight of the matrix using all of the heat-accumulation weightings corresponded by the row indices and all of the heat-accumulation weightings corresponded by the column indices; and using a driving module to provide energy to heating elements corresponding to the nozzles which will jet ink according to the total weight of the matrix.

14. The method of claim 13 wherein if both the nozzle and the directly preceding nozzle in the row are to jet ink, the row index of the nozzle is incremented from the row index of the directly preceding nozzle; and if both the nozzle and the directly preceding nozzle in the column are to jet ink, the column index of the nozzle is incremented from the column index of the directly preceding nozzle.

15. The method of claim 14 wherein a greater row or column index corresponds to an equal or greater heat-accumulation weighting.

16. The method of claim 13 wherein the total weight of the matrix is a sum of all of the heat-accumulation weightings corresponded by the row indices and all of the heat-accumulation weightings corresponded by the column indices.

17. A method for driving an ink jet print head of a printing apparatus, the ink jet print head comprising a plurality of ink cells for containing ink, each ink cell comprising a nozzle and a heating element, the method comprising:

using a calculation module to calculate a row index and a column index of each nozzle in a two-dimensional matrix, the two-dimensional matrix having a plurality of rows and a plurality of columns, the nozzle being positioned in a row and in a column, wherein:

if the nozzle is to jet ink, and a directly preceding nozzle in the row is not to jet ink, then the row index of the nozzle is reset;

if the nozzle is to jet ink, and the directly preceding nozzle in the row is also to jet ink, then the row index of the nozzle is calculated based on a row index of the directly preceding nozzle;

if the nozzle is not to jet ink, and the directly preceding nozzle in the row is to jet ink, then the row index of the nozzle is reset;

if the nozzle is not to jet ink, and the directly preceding nozzle in the row is also not to jet ink, then the row index of the nozzle is calculated based on the row index of the directly preceding nozzle;

if the nozzle is to jet ink, and a directly preceding nozzle in the column is not to jet ink, then the column index of the nozzle is reset;

if the nozzle is to jet ink, and the directly preceding nozzle in the column is also to jet ink, then the column index of the nozzle is calculated based on a column index of the directly preceding nozzle;

if the nozzle is not to jet ink, and the directly preceding nozzle in the column is to jet ink, then the column index of the nozzle is reset;

if the nozzle is not to jet ink, and the directly preceding nozzle in the column is also not to jet ink, then the column index of the nozzle is calculated based on the column index of the directly preceding nozzle;

corresponding row indices of all nozzles which will jet ink in the matrix to heat-accumulation weightings according to a heat-accumulation weighting table, the heat-accumulation weightings corresponded by the row indices of all the nozzles which will jet ink having at least two different values;

corresponding row indices of all nozzles which will not jet ink in the matrix to heat-dilution weightings according to a heat-dilution weighting table;

corresponding column indices of all the nozzles which will jet ink in the matrix to heat-accumulation weightings according to the heat-accumulation weighting table;

corresponding column indices of all the nozzles which will not jet ink in the matrix to heat-dilution weightings according to the heat-dilution weighting table;

using the calculation module to calculate a total weight of the matrix using heat-accumulation weightings corresponded by row indices and column indices of all the nozzles which will jet ink in the matrix and heat-dilution weightings corresponded by the row indices and column indices of all the nozzles which will not jet ink in the matrix; and using a driving module to provide energy to heating elements corresponding to the nozzles which will jet ink according to the total weight of the matrix.

18. The method of claim 17 wherein if both the nozzle and the directly preceding nozzle in the row are to jet ink, or neither the nozzle nor the directly preceding nozzle in the row is to jet ink, the row index of the nozzle is incremented from the row index of the directly preceding nozzle; and if both the nozzle and the directly preceding nozzle in the column are to jet ink, or neither the nozzle nor the directly preceding nozzle in the column is to jet ink, the column index of the nozzle is incremented from the column index of the directly preceding nozzle.

19. The method of claim 18 wherein a greater row or column index corresponds to an equal or greater heat-accumulation weighting.

20. The method of claim 17 wherein the total weight of the matrix is a difference of a sum of all of the heat-accumulation weightings corresponded by the row indices and all of the heat-accumulation weightings corresponded by the column indices and a sum of all of the heat-dilution weightings corresponded by the row indices and all of the heat-dilution weightings corresponded by the column indices.

* * * * *